US006233784B1

(12) United States Patent
Daoud

(10) Patent No.: US 6,233,784 B1
(45) Date of Patent: May 22, 2001

(54) HINGE

(75) Inventor: Bassel H. Daoud, Parsippany, NJ (US)

(73) Assignee: Avaya Inc., Basking Ridge, NJ (US)

( * ) Notice: Subject to any disclaimer, the term of this patent is extended or adjusted under 35 U.S.C. 154(b) by 0 days.

(21) Appl. No.: 09/399,881

(22) Filed: Sep. 21, 1999

(51) Int. Cl.[7] ..... E05D 7/10; E05D 5/12

(52) U.S. Cl. ..... 16/257; 16/380; 16/229; 16/268

(58) Field of Search ..... 16/229, 230, 257, 16/261–263, 268, 380

(56) References Cited

U.S. PATENT DOCUMENTS 2,474,311 * 6/1949 Graham ..... 16/257
2,475,887 * 7/1949 Gould ..... 16/257
3,895,838 * 7/1975 Hamada ..... 16/229
3,908,227 * 9/1975 Cain ..... 16/229
4,302,866 * 12/1981 Irvin ..... 16/257
4,455,711 * 6/1984 Anderson ..... 16/229
5,551,125 * 9/1996 Adams ..... 16/229

* cited by examiner

*Primary Examiner*—Chuck Y. Mah
(74) *Attorney, Agent, or Firm*—Hedman & Costigan, P.C.

(57) ABSTRACT

The present invention is directed to a hinge for releasably attaching two components in pivotable relation comprising a first member having a detent on a flexible arm, said arm being movable from an engagement to a disengagement position, and a stop member being adaptable from a static position adjacent the flexible arm to prohibit movement thereof when the flexible arm is in the engagement position to a retracted position allowing movement of the flexible arm into the disengagement position; and a second member corresponding to the first member having a fixed post including cooperating means for engagement of said detent when the flexible arm is in its engagement position. The stop member also preferably has a retention catch thereon which bears against the flexible arm to restrain the flexible arm in its disengagement position.

12 Claims, 5 Drawing Sheets

HINGE

FIELD OF THE INVENTION

The present invention relates to the field of hinges for providing pivotable movement between two components.

BACKGROUND OF THE INVENTION

Hinges have long been known for allowing two components to pivot with respect to one another. Generally, each of the two components has attached thereto one of two corresponding members of the hinge which interact to provide pivotable movement.

However, it is often the case that either the two corresponding hinge members are easy to assemble and disassemble or the hinge members provide a secure attachment between the hinge members, but not both. In other words, many known hinges have cooperating members which can be easily interconnected but then tend to disconnect or fail just as easily. Alternatively, the cooperating hinge members are securely connected but are difficult or time consuming to assemble and disassemble in the field.

SUMMARY OF THE INVENTION

The present invention is directed to a hinge for releasably attaching two components in pivotable relation comprising a first member having a detent on a flexible arm, said arm being movable from an engagement to a disengagement position, and a stop member being adaptable from a static position adjacent the flexible arm to prohibit movement thereof when the flexible arm is in the engagement position to a retracted position allowing movement of the flexible arm into the disengagement position; and a second member corresponding to the first member having a fixed post including cooperating means for engagement of said detent when the flexible arm is in its engagement position.

The stop member preferably includes a retention catch for holding the flexible arm in its disengagement position.

Most preferably, the first and second members are formed integral with the respective components to be pivoted, of a high impact polymer material.

BRIEF DESCRIPTION OF THE DRAWINGS

The following drawings, in which like reference characters refer to like parts, are presented merely to illustrate the preferred embodiment of the invention without limiting the invention in any manner whatsoever.

DETAILED DESCRIPTION OF THE PREFERRED EMBODIMENT

Figure 1:
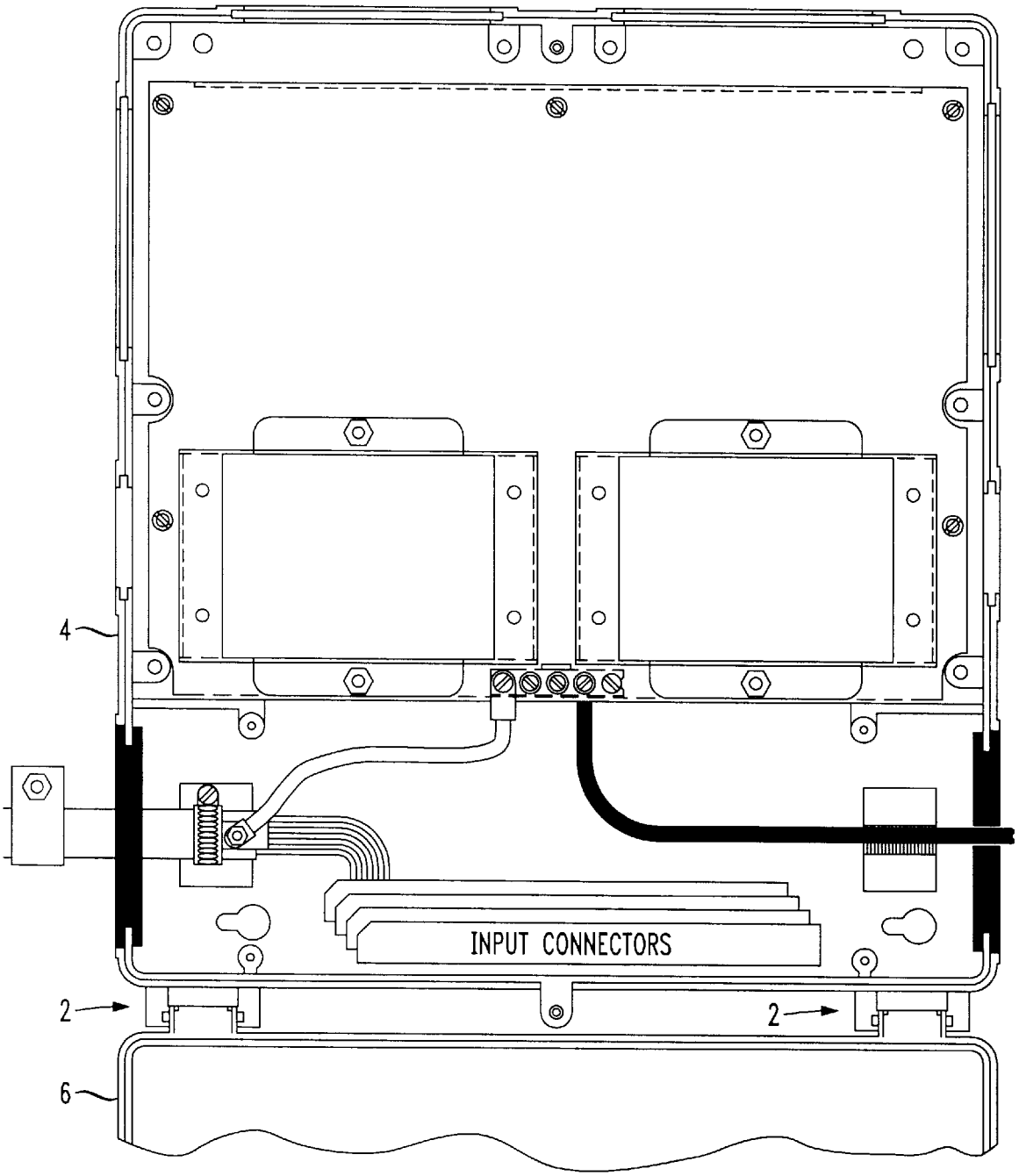
FIG. 1 is a plan view of the preferred embodiment of the hinge of the present invention on an electrical box.

As shown in FIG. 1, the hinge 2 of the present invention is used between a first component 4 and a second component 6 adapted to move in pivotable relation to one another such as the base and cover of a box. Each of the components 4 and 6 has mounted thereon one of two cooperating portions which together form the hinge 2, a first member 8 and a second member 10. Generally, it does not matter which component 4 or 6 is provided with which of the cooperating members 8 or 10 of the hinge 2.

Figure 2:
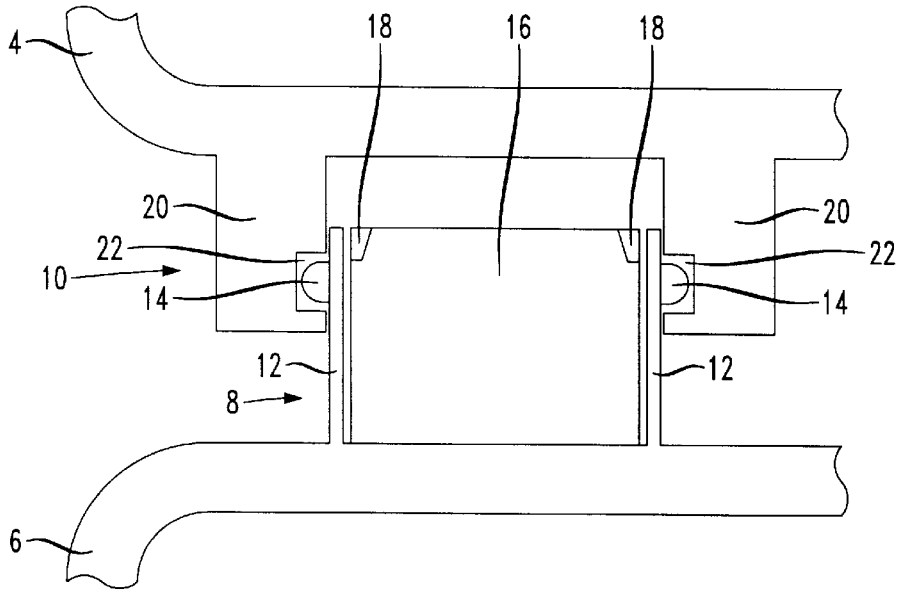
FIG. 2 is a partial plan view of the preferred embodiment of the present hinge with the first member in its engagement position.
Figure 3:
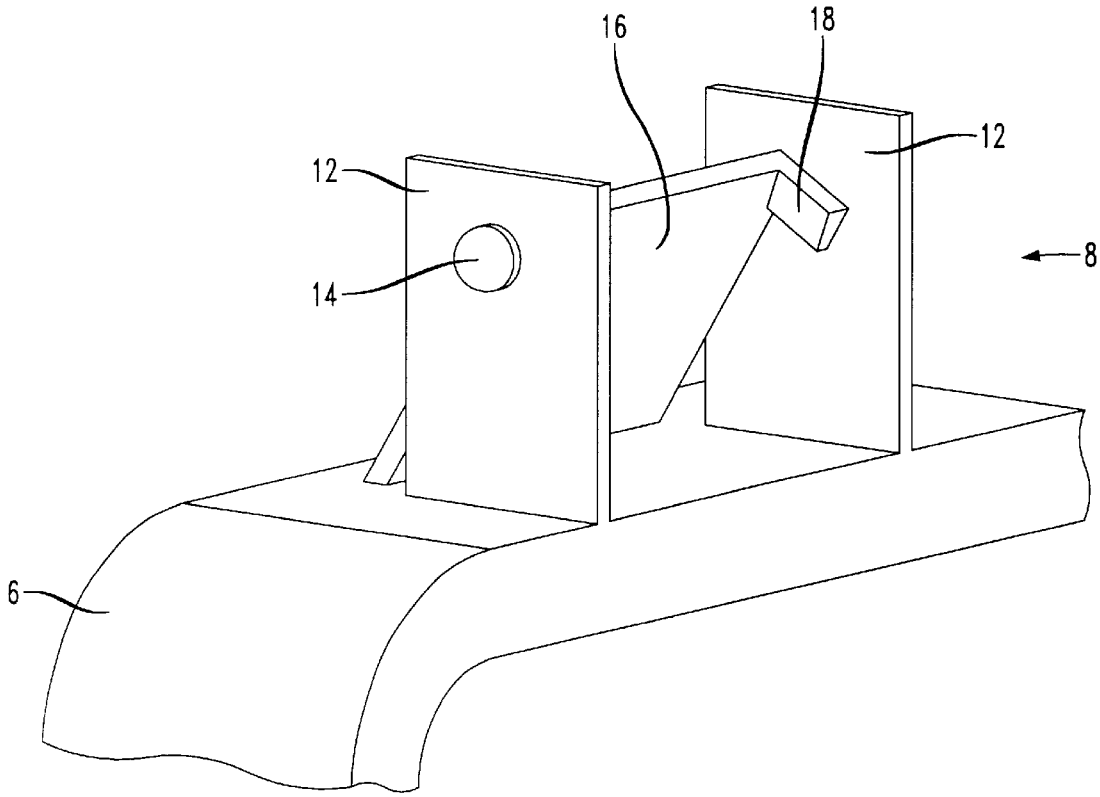
FIG. 3 is a partial perspective view of the first member of the preferred embodiment of the present hinge in its engagement position.
Figure 4:
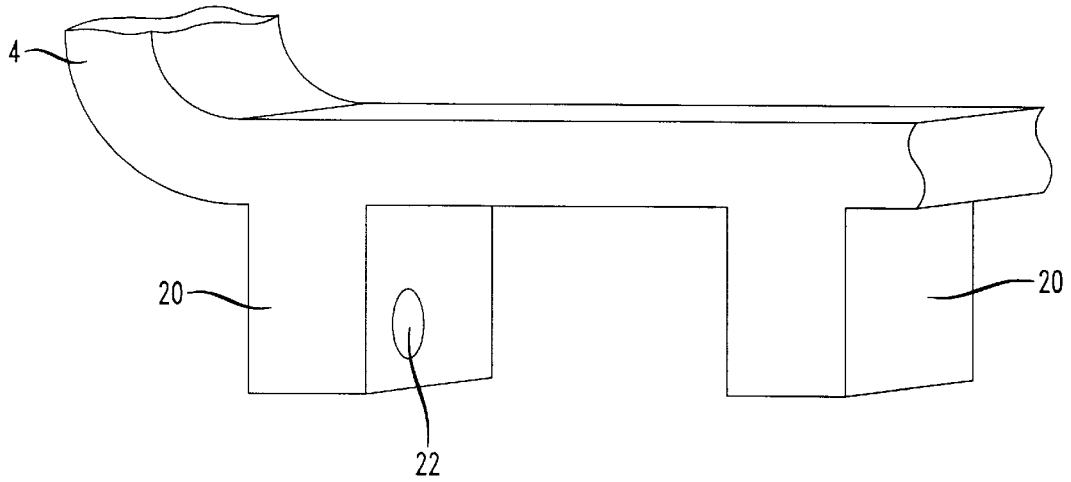
FIG. 4 is a partial perspective view of the second member of the preferred embodiment of the present hinge.
Figure 5:
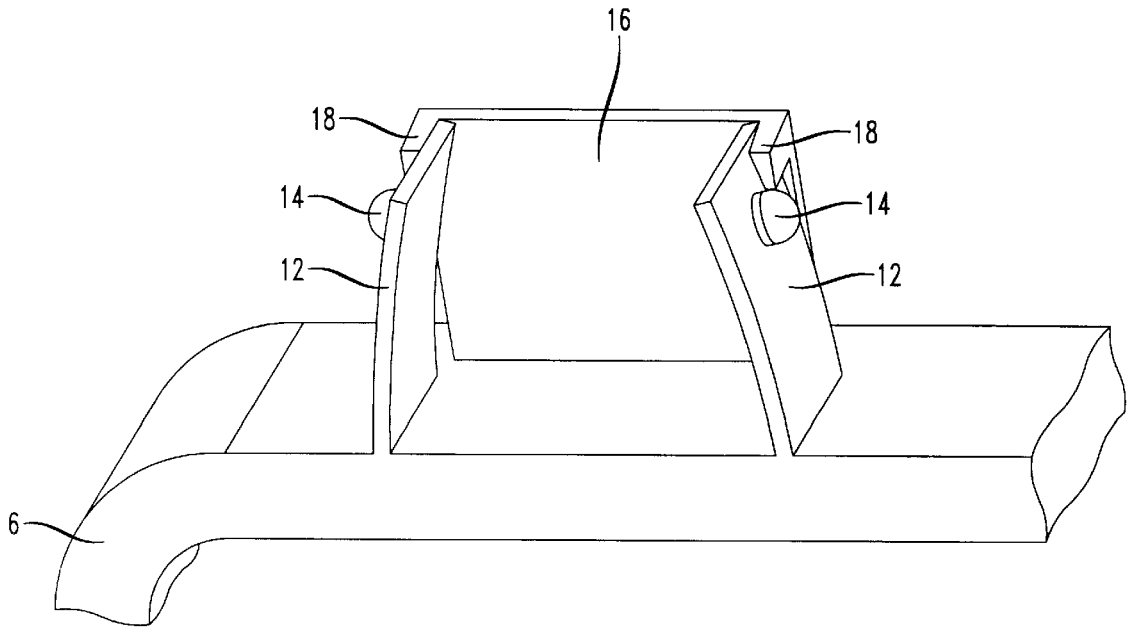
FIG. 5 is a partial perspective view of the first member of the preferred embodiment of the present hinge in its disengagement position.
Figure 6:
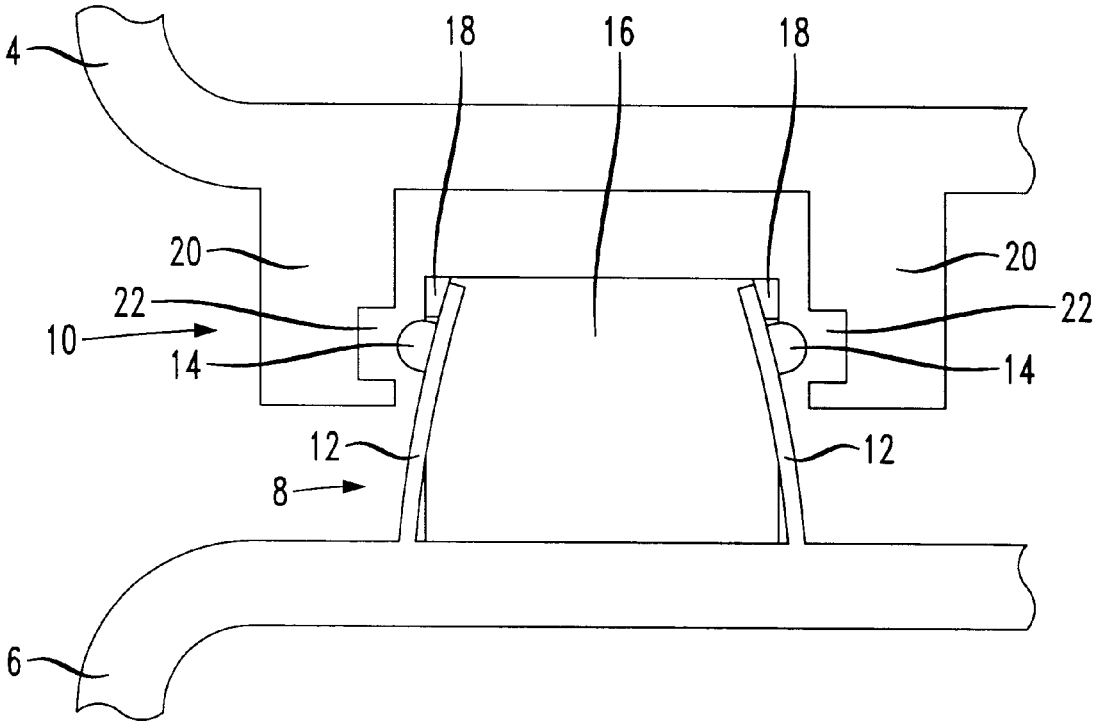
FIG. 6 is a partial plan view of the preferred embodiment of the present hinge with the first member in its disengagement position.
Figure 7:
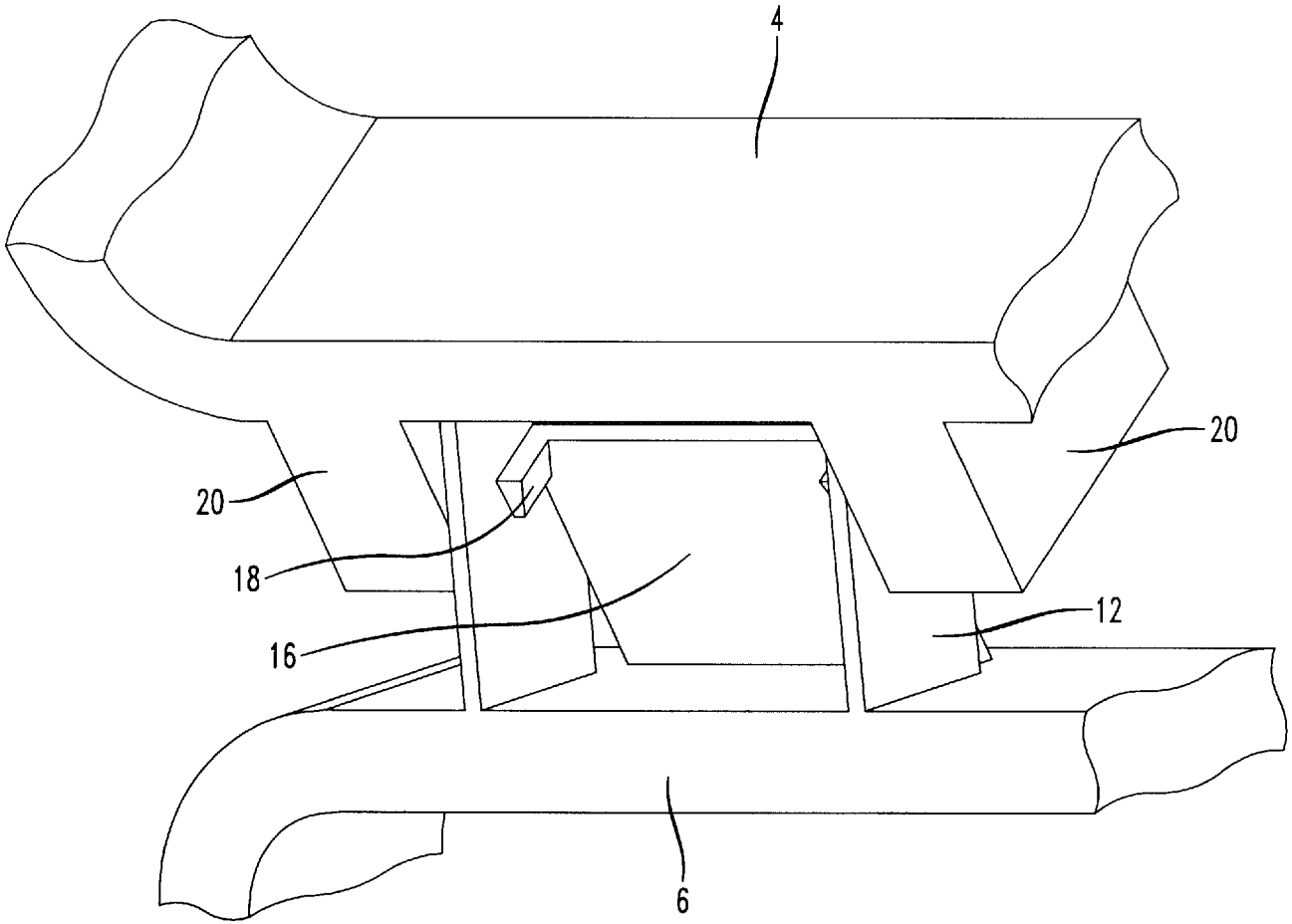
FIG. 7 is a partial perspective of the hinge of the present invention in its engaged configuration.

The first member 8 of the hinge 2 of the present invention preferably comprises opposed flexible arms 12 extending from the component 6 having detents 14 extending outwardly therefrom. The flexible arms 12 are movable from an engagement position, as shown in FIGS. 2 and 3, to a disengagement position, as shown in FIGS. 5 and 6, upon the application of an inwardly compressive force on the flexible arms 12. The detents 14 are adapted to engage cooperating means such as concave openings 22 on the second member 10 when the flexible arms 12 are in their engagement position.

A stop member 16 also preferably extends from the component 6 so that at least a portion of the stop member 16 is positioned between said flexible arms 12 when no force is exerted on the stop member 16. The stop member 16 acts to prohibit the flexible arms 12 from being moved into their disengagement position by physically blocking the flexible arms 12 when no force is applied to the stop member 16.

However, the stop member 16 is also movable so that upon the exertion of a force, the stop member 16 can be retracted from a static position between the flexible arms 12 to a retracted position out of the area between the flexible arms 12. When the stop member 16 is in its retracted position, the flexible arms 12 can be moved inwardly toward each other into their disengagement position.

Most preferably, the stop member 16 includes retention catches 18 relating to each of the flexible arms 12. As shown in FIGS. 5 and 6, the retention catches 18 rise from the surface of the stop member 16 facing the area between the flexible arms 12 to bear against at least a portion of the flexible arms 12. The retention catches 18 restrain the flexible arms 12 in their disengagement position. The retention catches 18 are preferably angled coincident with the angle of the end of the flexible arm 12 which bear against the retention catches 18 when the flexible arms 12 are in their disengagement position.

The second member 10 comprises fixed posts 20 having inward detents or concave openings 22 therein. The concave openings 22 correspond to the outwardly extending detents 14 of the first member 8, for receiving the detents 14 when the hinge members 8 and 10 are engaged and the flexible arms 12 are in their engagement position. The size of the concave openings 22 preferably correspond closely to the size of the outwardly extending detents 14.

For assembly or disassembly, the technician applies a retracting force to the stop member 16, to remove the stop member 16, including the retention catches 18, from the area between the flexible arms 12. The flexible arms 12 are then moved inwardly toward each other, into their disengagement position. The stop member 16 is then allowed to move toward the flexible arms 12. Once the face 17 of the stop member 16 contacts the sides of the flexible arms 12 the flexible arms 12 are released and are restrained from moving into their engagement position by the retention catches 18 on the stop member 16 which bear against the flexible arms 12.

For assembly, the first member 8 is positioned within the fixed posts 20 of the second member 10. The stop member 16 is retracted so that the retention catches 18 do not interfere with the flexible arms 12 and the flexible arms 12 are allowed to move into their engagement position with the outwardly extending detents 14 entering the concave openings 22 of the fixed posts 20. The stop member 16 is then also released and moves to its static position between the flexible arms 12 to prohibit inward movement of the flexible arms 12 into their disengagement position.

The first and second members 8 and 10 are preferably formed integral with the components 4 and 6, preferably of a polymer and, most preferably, of polycarbonate. Alternatively, however, the hinge members 8 and 10 can each be mounted on a base or similar device which is attached to the components 4 and 6.

The size of the hinge members 8 and 10, and the elements associated therewith, is not considered an essential part of the present invention. Of course, as a general rule, the size of the detents 14, flexible arms 12, fixed posts 20 and openings 22 are dependent on the application, a bigger box requiring more mass. For a normal application of a small electrical box, it has been found that a flexible arm 12 being about ¾"–1" high and having a outwardly extending detent 14 of about ⅛" to ¼' in diameter and extending outwardly about ⅛' to ¼' is suitable. In such an example, the tolerance between the flexible arms 12 and the stop member 16 is preferably not greater than 1/32".

Variations or modifications to the above described embodiment will make themselves apparent to one skilled in the art reviewing the above. For instance, the outwardly extending detents 14 can be placed on the fixed posts 20 and the concave openings 22 on the flexible arms 12. All such obvious variations and modifications are intended to fall within the spirit and scope of the invention, limited only by the following claims.

I claim:

1. A hinge for releasably attaching two components in pivotable relationship comprising:

(a) a first member having a detent on a flexible arm, said arm being movable from an engagement position to a disengagement position, and a stop member being movable from a static position adjacent the flexible arm, to prohibit movement of the flexible arm from the engagement position into the disengagement position, to a retracted position, allowing movement of the flexible arm from the engagement position into the disengagement position; and (b) a second member corresponding to the first member having a fixed post including cooperating means for engagement of said detent when the flexible arm is in its engagement position.

2. The hinge of claim 1 wherein the first member comprises two opposed flexible arms with the stop member positioned therebetween when the stop member is in its static position and the second member comprises two opposed fixed posts corresponding thereto.

3. The hinge of claim 1 wherein the stop member includes a retention catch for retaining the flexible arm in its disengagement position.

4. The hinge of claim 2 wherein the stop member includes two retention catches, one for retaining each of the flexible arms in their disengagement position.

5. The hinge of claim 1 wherein the detent comprises an outwardly extending member on the flexible arm and the cooperating means comprises a concave opening for receiving the detent.

6. The hinge of claim 1 wherein the detent is a concave opening on the flexible arm and the cooperating means comprises an outwardly extending member.

7. The hinge of claim 1 wherein the first member is formed integrally with one of the components attached in pivotable relation and the second member is formed integrally with the other component attached in pivotable relation.

8. A hinge for releasably attaching two components in pivotable relation comprising:

(a) a first member comprising a pair of opposed flexible arms having a detents thereon, said arms being movable from an engagement position inwardly toward each other to a disengagement position, and a stop member being movable from a static position between the flexible arms to prohibit inward movement thereof when the flexible arms are in the engagement position to a retracted position allowing inward movement of the flexible arms into the disengagement position; and (b) a second member corresponding to the first member having a fixed post including cooperating means for engagement of said detent when the flexible arm is in its engagement position.

9. The hinge of claim 8 wherein the stop member includes two retention catches, one for retaining each of the flexible arms in their disengagement position.

10. The hinge of claim 8 wherein the detents comprise an outwardly extending member on the flexible arm and the cooperating means comprises a concave opening for receiving the detent.

11. The hinge of claim 8 wherein the detents are concave openings on the flexible arms and the cooperating means comprises an outwardly extending member.

12. The hinge of claim 8 wherein the first member is formed integrally with one of the components attached in pivotable relation and the second member is formed integrally with the other component attached in pivotable relation.

* * * * *